US006531809B1

(12) United States Patent
Benedikt et al.

(10) Patent No.: US 6,531,809 B1
(45) Date of Patent: Mar. 11, 2003

(54) SPARK PLUG HAVING GROUND ELECTRODE AND INTERMEDIATE ELECTRODE SEPARATED BY INSULATING BODY

(75) Inventors: Walter Benedikt, Kornwestheim (DE); Werner Herden, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/502,616

(22) Filed: Feb. 11, 2000

(30) Foreign Application Priority Data

Feb. 12, 1999 (DE) ..... 199 05 771

(51) Int. Cl.[7] ..... H01T 13/00; H01T 13/20; H01T 13/22

(52) U.S. Cl. ..... 313/143; 313/131 R; 313/139; 313/141

(58) Field of Search ..... 313/143, 131 R, 313/141, 140, 130, 139, 123, 144

(56) References Cited

U.S. PATENT DOCUMENTS 2,957,099 A * 10/1960 Dutterer ..... 313/131 R
3,004,184 A 10/1961 Deans
3,522,465 A * 8/1970 Knippenberg et al. .. 313/131 R
5,449,966 A 9/1995 Turkowski
5,612,586 A * 3/1997 Benedikt et al. ..... 313/123
5,818,152 A * 10/1998 Bolduan et al. ..... 313/141
5,950,584 A * 9/1999 Bubeck ..... 123/169 E

FOREIGN PATENT DOCUMENTS

DE 151 524 10/1903
DE 164 902 1/1904
GB 434009 8/1935
JP 04138685 A * 5/1992 ..... H01T/13/20

* cited by examiner

*Primary Examiner*—Nimeshkumar D. Patel
*Assistant Examiner*—Sikha Roy

(57) ABSTRACT

A spark plug is described that includes a housing, an insulator nose attached to the housing, a center electrode inserted through the insulator nose and projecting over the insulator nose tip, an intermediate electrode separated from the center electrode by a first spark gap, and a ground electrode attached to the housing. A solid-state insulating body, which forms a second spark gap in the form of a surface gap passing over the solid-state insulating body, is provided between the intermediate electrode and the ground electrode.

18 Claims, 5 Drawing Sheets

SPARK PLUG HAVING GROUND ELECTRODE AND INTERMEDIATE ELECTRODE SEPARATED BY INSULATING BODY

FIELD OF THE INVENTION

The present invention relates to a spark plug having a housing, an insulator nose attached to the housing, a center electrode inserted through the insulator nose and projecting above the insulator nose tip, an intermediate electrode separated from the center electrode by a first spark gap, and a ground electrode attached to the housing.

BACKGROUND INFORMATION

Double-spark plugs of this type are described in German Patent No. 151 524.

Double-spark plugs that have two center electrodes also are described in German Patent No. 164 902.

Although it can be used for any spark plug, the present invention and its underlying principle are explained in relation to an on-board spark plug in the spark-ignition engine of a motor vehicle.

Generally speaking, the air/fuel mixture in the combustion chamber of each cylinder of the spark-ignition engine must be reliably ignited by the relevant spark plug with each combustion cycle to avoid misfiring, which could, for example, damage the catalytic converter.

Conventional spark plugs cannot guarantee reliable flame cone formation at high flow rates and in the case of mixture inhomogeneity, in particular in certain combustion chamber arrangements (for example, if the injection valve is oriented toward the spark plug). This problem can be overcome, for example, by increasing the igniting voltage at higher flow rates and in the case of mixture inhomogeneity. However, this procedure is complicated.

SUMMARY OF THE INVENTION

The spark plug according to the present invention has the advantage over conventional approaches in that flame cones are formed at two ignition sites using a single ignition operation. This greatly increases the probability of a reliable flame cone formation without requiring any additional measures.

According to the present invention, a solid-state insulating body, which forms a second spark gap in the form of a surface gap passing over the solid-state insulating body, is provided between the intermediate electrode and the ground electrode.

According to one example embodiment, the solid-state insulating body device is in the shape of a ring. Due to the ring symmetry, the second spark is advantageously formed on a surface gap that forms in the location of the lowest mixture flow rate, i.e., on the lee side.

According to a further example embodiment, the ground electrode, intermediate electrode, and solid-state insulating body form a largely flush transition surface on the outer ring surface of the solid-state insulating body, with the second spark gap in the form of the surface gap being provided on this transition surface. The advantage of this is that a spark does not form inside t-he spark plug, but rather only on the spark plug exterior.

According to another example embodiment, the ground electrode, intermediate electrode, and solid-state insulating body each form a shoulder on the inner ring surface of the solid-state insulating body, with the formation of the second spark gap in the form of the surface gap being limited by this shoulder.

According to another example embodiment, the ground electrode, intermediate electrode and solid-state insulating body form a largely flush transition surface on the outer ring surface and the inner ring surface of the solid-state insulating body, with the outer ring surface of the solid-state insulating body being narrower than the inner ring surface so that the second spark gap in the form of the surface gap passes along the outer ring surface.

According to another example embodiment, the ground electrode and/or the intermediate electrode can be screwed onto the solid-state insulating body. The advantage of this is that these components can be replaced.

According to another example embodiment, the ground electrode, intermediate electrode, and solid-state insulating body have a cylindrically symmetrical shape.

According to another example embodiment, the intermediate electrode has at least one intermediate electrode finger at which the first spark gap is aimed from the center electrode.

According to another example embodiment, the first spark gap is a spark gap in air.

According to another example embodiment, the first spark gap is a surface gap that passes at least partially over the insulator nose.

According to another example embodiment, a third spark gap is provided between the center electrode and the intermediate electrode, with either the first or the third spark gap being a spark gap in air and the other being a surface gap that passes at least partially over the insulator nose.

According to another example embodiment, at least one further intermediate electrode and one further corresponding solid-state insulating body are provided between the ground electrode and the solid-state insulating body.

According to another example embodiment, the solid-state insulating body is made of ceramic.

DETAILED DESCRIPTION

For the present invention, the figures show only some of the components of the spark plugs according to the embodiments, with the remaining components omitted in the interest of clarity.

Figure 1A:
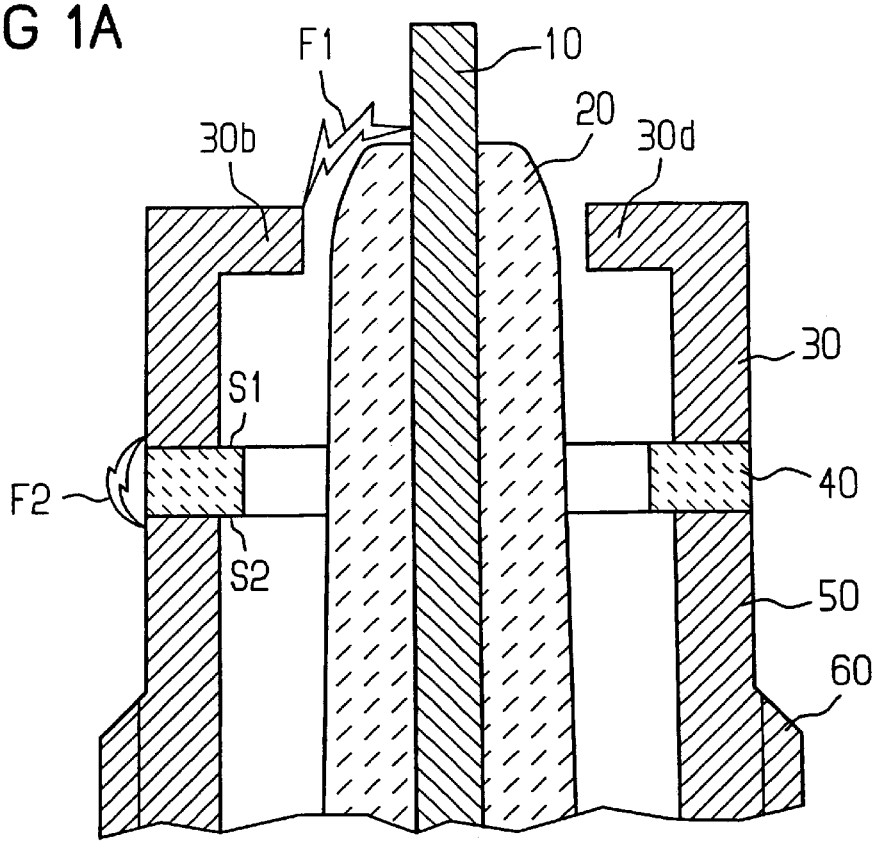
FIG. 1*a* shows a cross-sectional view of a schematic representation of a first embodiment of a spark plug according to the present invention.
Figure 1B:
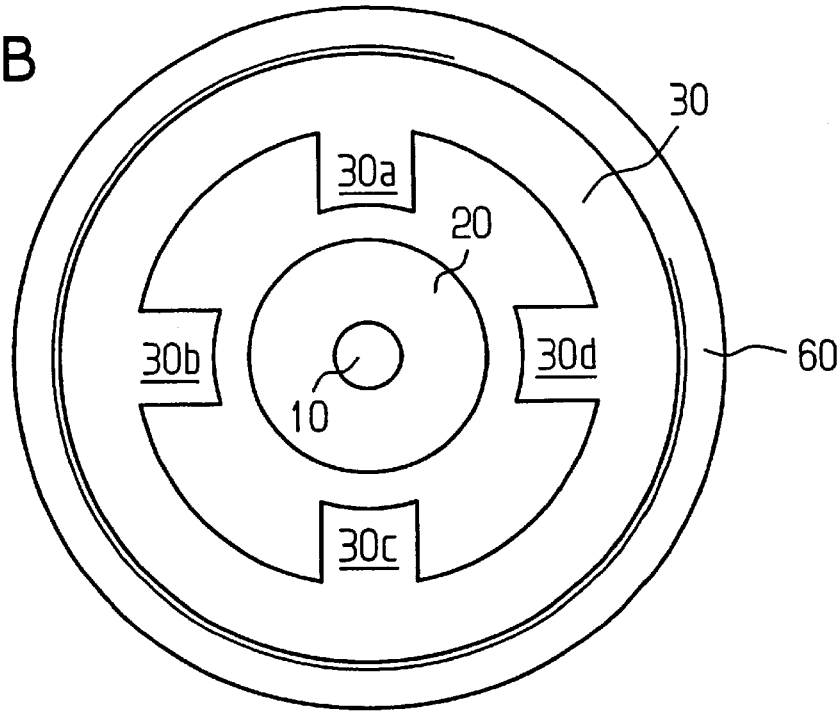
FIG. 1*b* shows a top view of a schematic representation of a first embodiment of a spark plug according to the present invention.

FIGS. 1*a* and 1*b* show a schematic representation of a spark plug according to a first embodiment of the present invention, with FIG. 1*a* showing a cross-sectional view and FIG. 1*b* a top view.

The spark plug according to the first embodiment has a housing 60, an insulator nose 20 attached to housing 60, and a center electrode 10 that is inserted through insulator nose 20 and projects above the insulator nose tip. The lower region of housing 60 usually has a threaded segment, which, however, is not illustrated here to simplify the representation.

An intermediate electrode 30, which is separated from center electrode 10 by a first spark gap F1, is provided in the upper region of the spark plug.

A ground electrode 50 is attached to housing 60 or formed by the latter. A solid-state insulating body 40 in the form of a ceramic ring is provided between intermediate electrode 30 and ground electrode 50, forming a second spark gap F2 in the form of a surface gap passing over solid-state insulating body 40. Like the ground electrode and the lower region of the intermediate electrode, solid-state insulating body 40 is in the shape of a ring.

Ground electrode 50, intermediate electrode 30, and solid-state insulating body 40 are designed so that they form a largely flush or flat transition surface on the outer ring surface of solid-state insulating body 40, with second spark gap F2 in the form of the surface gap being provided on this transition surface.

Shoulders S1, S2, which limit the formation of second spark gap F2 in the form of the surface gap, are provided on the inner ring surface of solid-state insulating body 40.

As shown, in particular, in FIG. 1*b*, intermediate electrode 30 has four intermediate electrode fingers 30*a–d* that are arranged at 90° angles and at which first spark gap F1 is aimed from center electrode 10.

Because intermediate electrode fingers 30*a–d* are arranged slightly below the insulator nose tip, first spark gap F1 is a surface gap that passes partially across insulator nose 20.

In this embodiment, both spark gaps F1 and F2 form in the location of the lowest mixture flow rate, i.e., on the lee side, when the mixture reaches a high flow rate. In FIG. 1*a*, this is the left side, assuming that the mixture flow rate runs from right to left.

Figure 2:
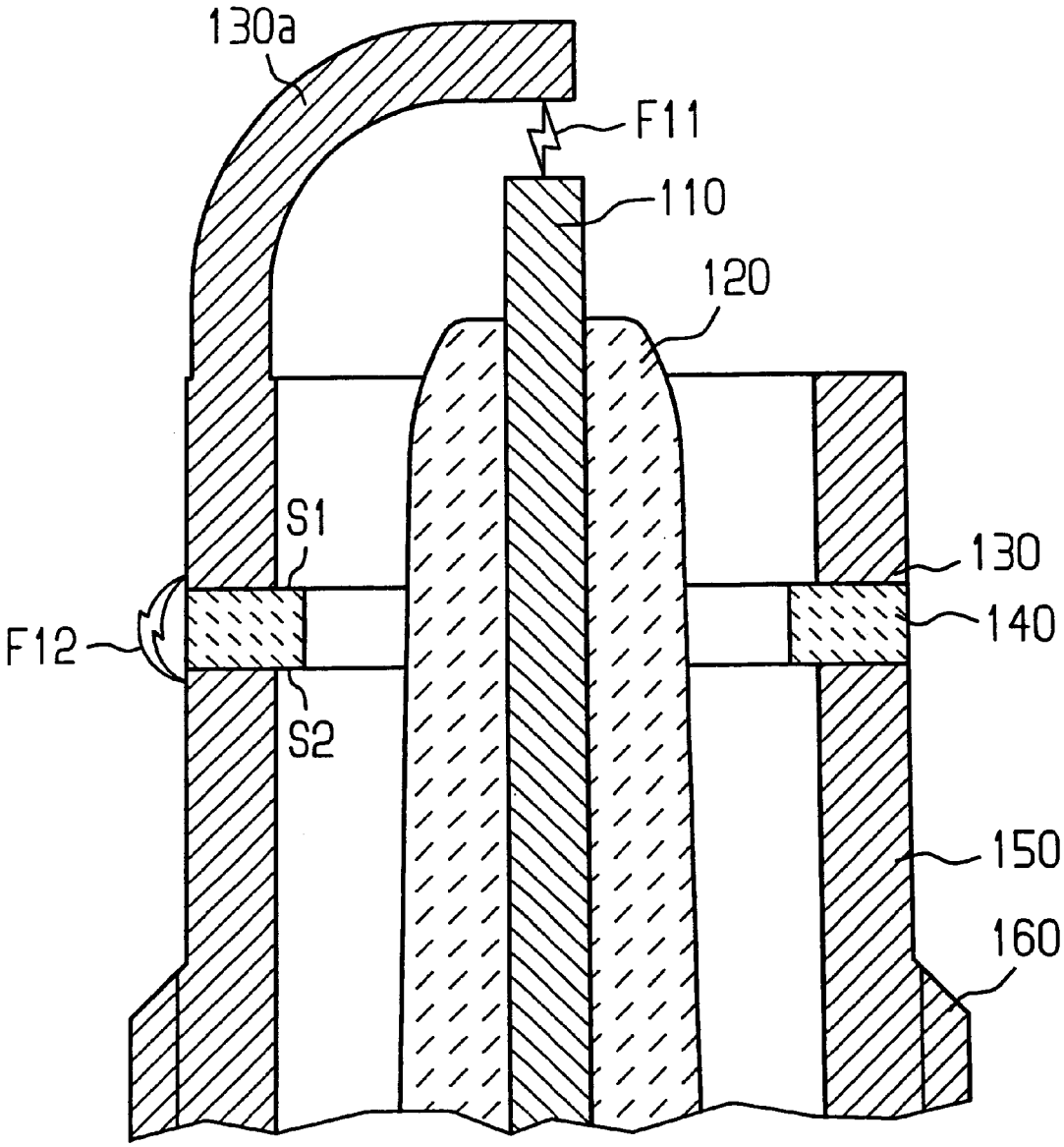
FIG. 2 shows a cross-sectional view of a schematic representation of a second embodiment of a spark plug according to the present invention.

FIG. 2 shows a schematic representation of a spark plug as a second embodiment of the present invention in a cross-sectional view.

In this second embodiment, the same components, or components with the same functions, are identified by the same reference numbers as in the first embodiment, but incremented by "100".

Unlike the first embodiment, first spark gap F11 in this embodiment is a spark gap in air, and only second spark gap F12 is a surface gap.

First spark gap F11 forms between a curved intermediate electrode finger 130*a* and the center electrode.

In this embodiment, at least spark gap F12 forms at the location of the lowest mixture flow rate, i.e., on the lee side, when the mixture reaches a high flow rate. In FIG. 2, this is the left side, assuming that the mixture flow rate runs from right to left.

Figure 3A:
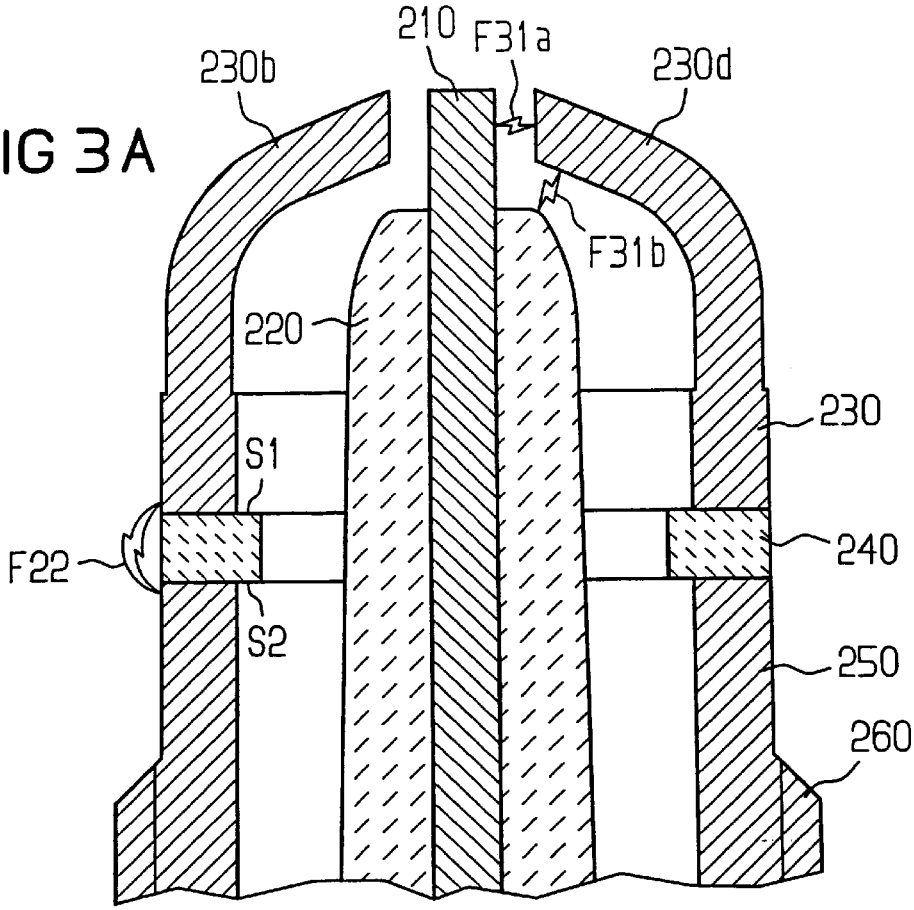
FIG. 3*a* shows a cross-sectional view of a schematic representation of a third embodiment of a spark plug according to the present invention.
Figure 3B:
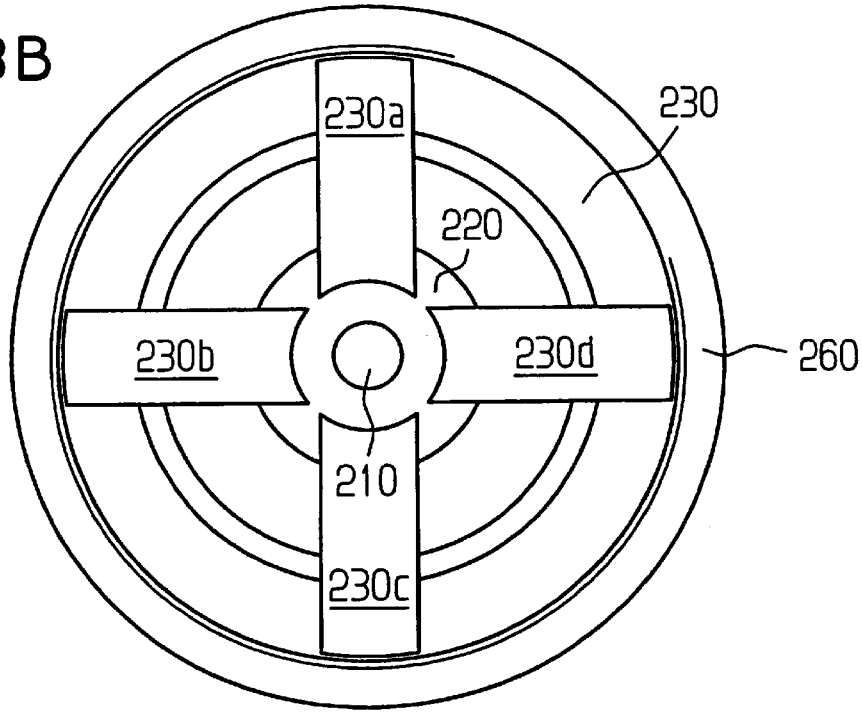
FIG. 3*b* shows a top view of a schematic representation of a third embodiment of a spark plug according to the present invention.

FIGS. 3*a* and 3*b* show a schematic representation of a spark plug as a third embodiment of the present invention, with FIG. 3*a* showing a cross-sectional view and FIG. 3*b* a top view.

In this third embodiment, the same components, or components with the same functions, are identified by the same reference numbers as in the first embodiment, but incremented by "200".

Unlike the first embodiment, first spark gap F31*a* in this embodiment is a spark gap in air, and second spark gap F22 is a surface gap.

First spark gap F31*a* forms between one of curved intermediate electrode fingers 230*a–d* and center electrode 210.

A third spark gap F31*b*, in the form of a surface gap that passes partially across insulator nose 220, forms between center electrode 210 and one of curved intermediate electrode fingers 230*a–d*.

In this embodiment, at least spark gap F22 forms at the location of the lowest mixture flow rate, i.e., on the lee side, when the mixture reaches a high flow rate. In FIG. 3*a*, this is the left side, assuming that the mixture flow rate runs from right to left.

Figure 4A:
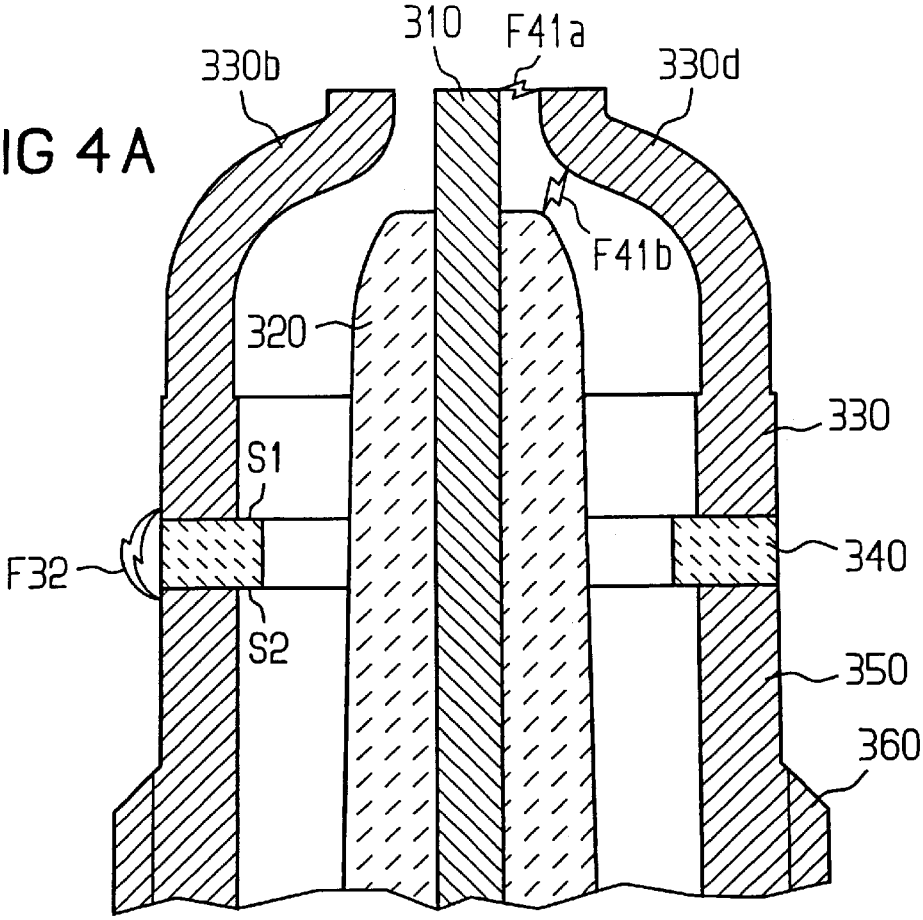
FIG. 4*a* shows a cross-sectional view of a schematic representation of a fourth embodiment of a spark plug according to the present invention.
Figure 4B:
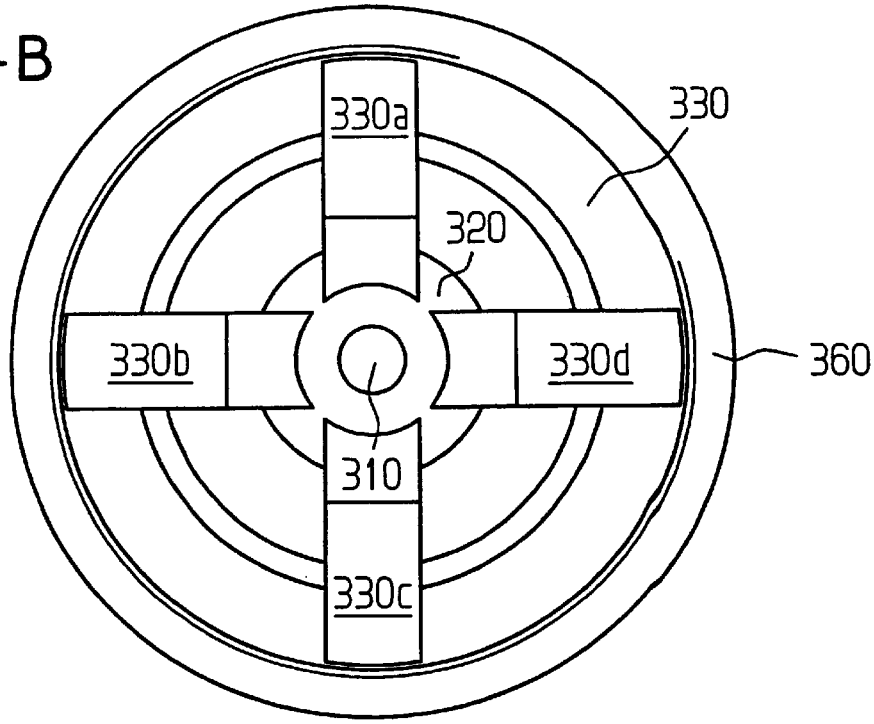
FIG. 4*b* shows a top view of a schematic representation of a fourth embodiment of a spark plug according to the present invention.

FIGS. 4*a* and 4*b* show a schematic representation of a spark plug as a fourth embodiment of the present invention, with FIG. 4*a* showing a cross-sectional view and FIG. 4*b* a top view.

In this fourth embodiment, the same components, or components with the same functions, are identified by the same reference numbers as in the first embodiment, but incremented by "300".

Unlike the first embodiment, first spark gap F41*a* in this embodiment is a spark gap in air, and second spark gap F32 is a surface gap.

First spark gap F41*a* forms between one of curved intermediate electrode fingers 330*a–d* and center electrode 310. The curvature of curved intermediate electrode fingers 330*a–d* in this embodiment is selected so that first spark gap F41*a* forms at the upper tip of center electrode 310.

Like in the third embodiment, a third spark gap F41*b* in the form of a surface gap that passes partially across insulator nose 320, forms between center electrode 310 and one of curved intermediate electrode fingers 330*a–d*.

In this embodiment as well, at least spark gap F32 forms at the location of the lowest mixture flow rate, i.e., on the lee side, when the mixture reaches a high flow rate. In FIG. 4*a*, this is the left side, assuming that the mixture flow rate runs from right to left.

Figure 5A:
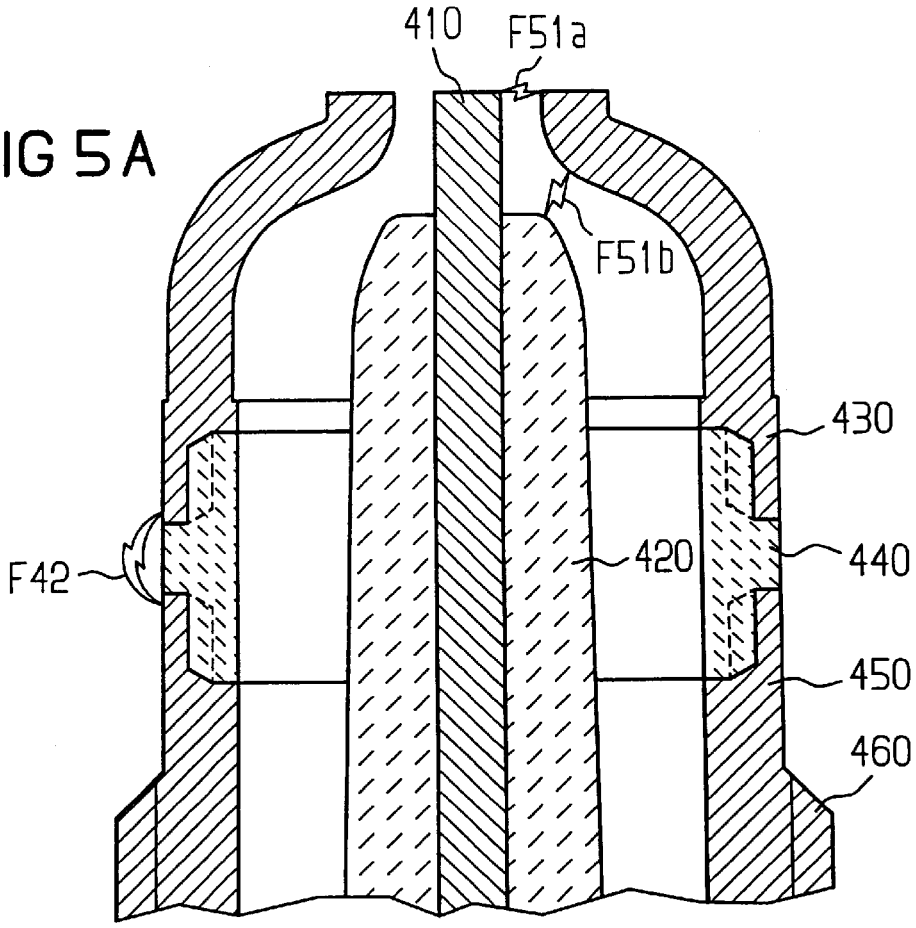
FIG. 5*a* shows a cross-sectional view of a schematic representation of a fifth embodiment of a spark plug according to the present invention.
Figure 5B:
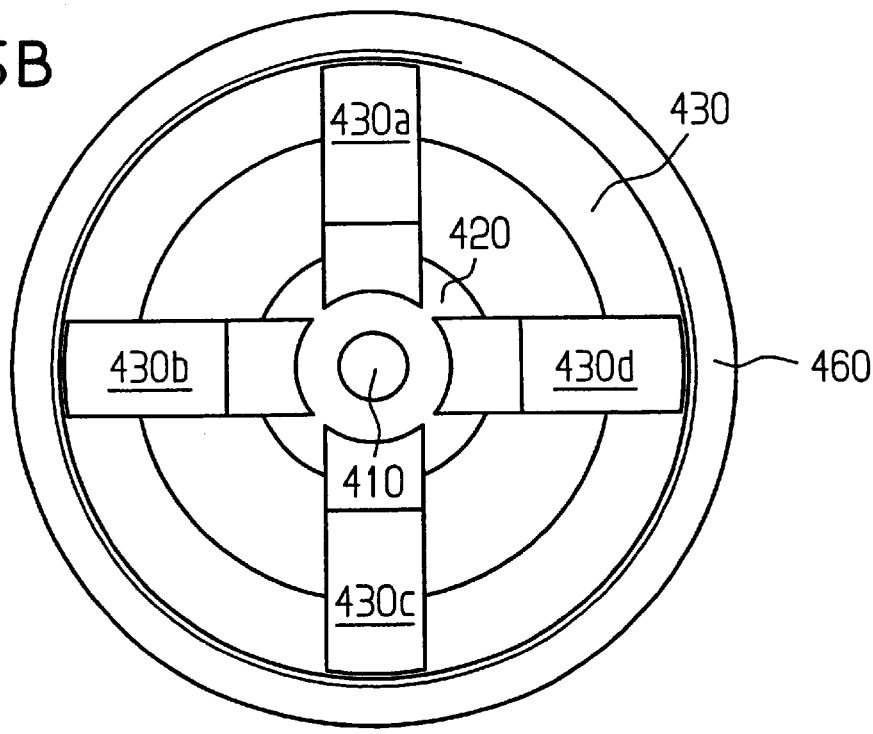
FIG. 5*b* shows a top view of a schematic representation of a fifth embodiment of a spark plug according to the present invention.

FIGS. 5*a* and 5*b* show a schematic representation of a spark plug as a fifth embodiment of the present invention, with FIG. 5*a* showing a cross-sectional view and FIG. 5*b* a top view.

In this fifth embodiment, the same components, or components with the same functions, are identified by the same reference numbers as in the first embodiment, but incremented by "400".

Unlike the fourth embodiment, ground electrode 450, intermediate electrode 430, and solid-state insulating body 440 are designed so that they form a largely flush or flat transition surface on the outer ring surface and the inner ring surface of solid-state insulating body 440.

In this case, the outer ring surface of solid-state insulating body 440 is narrower than the inner ring surface so that second spark gap F42 in the form of the surface gap passes along the outer ring surface.

In addition, both ground electrode 450 and intermediate electrode 430 can be screwed onto solid-state insulating body 440.

In this embodiment as well, at least spark gap F42 forms at the location of the lowest mixture flow rate, i.e., on the lee side, when the mixture reaches a high flow rate. In FIG. 5*a*, this is the left side, assuming that the mixture flow rate runs from right to left.

Although only one intermediate electrode was provided in the embodiments described above, multiple intermediate electrodes and corresponding solid-state insulating bodies can be provided between the ground electrode and solid-state insulating body.

All conventional models of ground-electrode spark plugs, including models that combine a surface gap with a spark gap in air, can be equipped with the surface gap passing over the solid-state insulating body according to the present invention.

What is claimed is:

1. A spark plug, comprising:

a housing;

an insulator nose attached to the housing;

a center electrode inserted through the insulator nose and projecting above the insulator nose;

a ground electrode attached to the housing;

an intermediate electrode separated on a first side-from the center electrode by a first spark gap, and separated on a second side from the ground electrode; and a ring-shaped solid-state insulating body positioned between the intermediate electrode and the ground electrode forming a second spark gap, the second spark gap being a surface gap passing over an outer ring surface of the solid-state insulating body, wherein:

an outer surface of the intermediate electrode, an outer surface of the ground electrode, and the outer ring surface of the solid-state insulating body are flush with respect to each other and form a transition surface on the outer ring surface of the solid-state insulating body, the second spark gap being provided on the transition surface.

2. The spark plug according to claim 1, wherein the ground electrode, the intermediate electrode, and the solid-state insulating body each form a shoulder on an inner ring surface of the solid-state insulating body, the formation of the second spark gap being limited by the shoulder.

3. The spark plug according to claim 1, wherein the ground electrode, the intermediate electrode, and the solid-state insulating body form a substantially flush transition surface on the outer ring surface of the solid-state insulating body and an inner ring surface of the solid-state insulating body, the outer ring surface being narrower than the inner ring surface so that the second spark gap passes along the outer ring surface.

4. The spark plug according to claim 3, wherein at least one of the ground electrode and the intermediate electrode is screwed onto the solid-state insulating body.

5. The spark plug according to claim 1, wherein the ground electrode, the intermediate electrode, and the solid-state insulating body have a symmetrical cylindrical shape.

6. The spark plug according to claim 1, wherein the intermediate electrode includes at least one intermediate electrode finger, the first spark gap being aimed from the center electrode at the at least one intermediate electrode.

7. The spark plug according to claim 1, wherein the first spark gap forms an air gap.

8. The spark plug according to claim 1, the first spark gap passes at least partially over the insulator nose.

9. The spark plug according to claim 1, wherein a third spark gap is provided between the center electrode and the intermediate electrode, one of the first spark gap and the third spark gap being an air gap and the other one of the first spark gap and the third spark gap being a surface gap that passes at least partially over the insulator nose.

10. The spark plug according to claim 1, further comprising:

at least one further intermediate electrode; and one further solid-state insulating body, the at least one further intermediate electrode and the one further solid-state insulating body being-provided between the ground electrode and the solid state insulating body.

11. The spark plug according to claim 1, wherein the solid-state insulating body is made of ceramic.

12. The spark plug according to claim 1, wherein:

the first spark gap is defined as an electrical path that extends between a portion of the center electrode projecting beyond the insulator nose and a surface of the intermediate electrode.

13. The spark plug according to claim 12, wherein:

the surface of the intermediate electrode defining the electrical path of the first spark gap is an exterior surface of the intermediate electrode.

14. The spark plug according to claim 12, wherein:

the surface of the intermediate electrode defining the electrical path of the first spark gap faces away from an exterior surface of the intermediate electrode.

15. The spark plug according to claim 12, wherein:

the surface of the intermediate electrode defining the electrical path of the first spark gap forms an acute angle with an exterior surface of the intermediate electrode.

16. The spark plug according to claim 1, wherein:

the first spark gap extends directly from a top of the center electrode to a top of the intermediate electrode.

17. The spark plug according to claim 16, wherein:

the top of the center electrode and the top of the intermediate electrode are in a plane that is parallel to a transverse axis of the center electrode.

18. The spark plug according to claim 1, wherein a spark of the second spark gap is formed only at an exterior of the outer ring surface of the solid-state insulating body and an exterior of the respective outer surfaces of the intermediate electrode and the ground electrode.

* * * * *